US006914988B2

(12) United States Patent
Irwan et al.

(10) Patent No.: US 6,914,988 B2
(45) Date of Patent: Jul. 5, 2005

(54) AUDIO REPRODUCING DEVICE

(75) Inventors: Roy Irwan, Eindhoven (NL); Erik Larsen, Urbana, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 281 days.

(21) Appl. No.: 10/234,805

(22) Filed: Sep. 4, 2002

(65) Prior Publication Data

US 2003/0044032 A1 Mar. 6, 2003

(30) Foreign Application Priority Data

Sep. 6, 2001 (EP) ..... 01203363

(51) Int. Cl.[7] ..... H04R 5/00
(52) U.S. Cl. ..... 381/22; 381/27
(58) Field of Search ..... 381/27–63, 21, 381/22, 19

(56) References Cited

U.S. PATENT DOCUMENTS 4,589,129 A * 5/1986 Blackmer et al. ..... 381/21
5,493,617 A * 2/1996 Waller, Jr. ..... 381/98
2002/0090092 A1 7/2002 Aarts et al. ..... 381/80

FOREIGN PATENT DOCUMENTS

EP 0462381 A2 12/1991
EP 0517233 A1 12/1992
WO WO0250831 6/2002 ..... G11B/20/00

* cited by examiner

*Primary Examiner*—Ping Lee

(57) ABSTRACT

An audio reproducing device includes an input for receiving an n-channel input signal, an output for supplying an 1-channel output signal to 1 loudspeakers, and an audio processing unit for processing the input signal. The audio processing unit a signal enhancer for enhancing an m-channel signal part of the n-channel input signal, where m<n, the signal enhancer having, for each channel signal part of said m-channel signal part, a non-linear anti-symmetric monotone transfer function. The audio reproducing device is further provided with a speech-music discriminator, which, in response to one of the channel signal parts of the m-channel signal part designated for speech, generates a control signal indicating the probability p that the one of the channel signal parts contains speech signals. This control signal is used to control the signal enhancer.

7 Claims, 1 Drawing Sheet

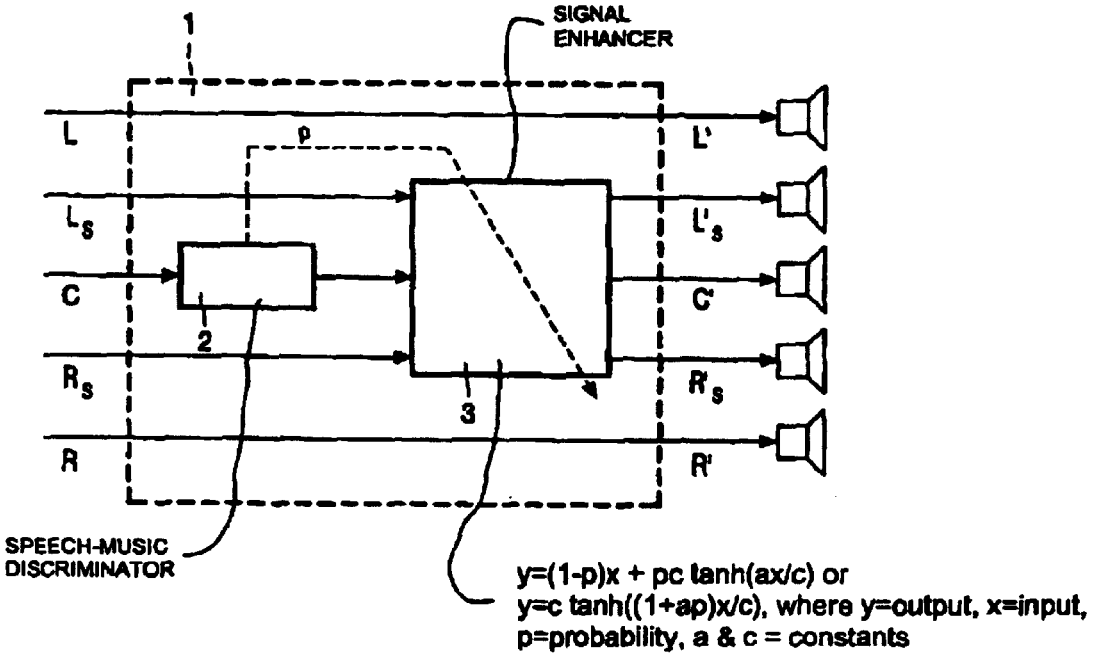
1
SIGNAL ENHANCER
L
p
L'
$L_S$
$L'_S$
C
C'
2
$R_S$
$R'_S$
3
R
R'
SPEECH-MUSIC DISCRIMINATOR
y=(1-p)x + pc tanh(ax/c) or
y=c tanh((1+ap)x/c), where y=output, x=input,
p=probability, a & c = constants

AUDIO REPRODUCING DEVICE

BACKGROUND OF THE INVENTION

1. Field of the Invention

The invention relates to an audio reproducing device with an input for receiving an n-channel input signal, an output for supplying an 1-channel output signal to 1 loudspeakers, and an audio processing unit for processing the input signal, the audio processing unit comprising enhancing means for enhancing an m-channel signal part of the n-channel input signal, where m<n, the enhancing means having, for each channel signal part of said m-channel signal part, a non-linear anti-symmetric monotone transfer function.

2. Description of the Related Art

International Patent Application No. WO 02/50831 A2, corresponding to U.S. Patent Publication No. US 2002/090092 A1 (PHNL000696EPP), discloses such an audio reproducing device. This known audio reproducing device is used to enhance the reproduction of multi-channel sound. Particularly, the center and surround channels are processed by a non-linear device to enhance speech intelligibility and boost subtle surround effects.

However, it is often desirable only to improve the speech intelligibility of a multi-channel reproduction. Surround effects might not need to be processed in this case. A very simple solution is to apply the above enhancement only to the center channel, normally used for speech, and not to the surround channels. This has the disadvantage that signals in the center channel, which are not speech, will still be processed.

SUMMARY OF THE INVENTION

It is an object of the invention to avoid this disadvantage. Therefore, in accordance with the invention, the audio reproducing device as described in the opening paragraph, is characterized in that the audio reproducing device is provided with a speech-music discriminator, which, in response to one of the channel signal parts of said m-channel signal part designated for speech, provides a control signal indicating the probability p that said one of the channel signal parts comprises speech signals, said control signal controlling the enhancing means.

A speech-music discriminator is known per se and described in "A Real-time Speech-Music Discriminator", by Ronald M. Aarts and Robert Toonen Dekker, J. Audio Eng. Soc., Vol. 47, No. 9, September, 1999, p. 720–725. The device described in this document supplies, in response to a single-channel audio signal, a signal with a value p between 0 and 1, indicating the probability that the audio input signal comprises speech. According to the invention, a speech-music discriminator, e.g., of the type described in said document, is combined with a sound enhancement device, e.g., of the type as described in WO 02/50831 A2. The degree in which speech enhancement is realized without effecting surround sounds or enhancing sounds other than speech in the one of the channel signals parts, i.e., the channel of which the probability value p is determined, is made dependent on the value of the probability p.

In a more practical embodiment, the audio reproducing device is characterized in that the n-channel input signal includes a center channel signal part, particularly designated for speech, and surround channel signal parts, and the speech-music discriminator provides for said control signal in response to said center channel signal part, while said control signal controls the enhancing means for enhancing the center channel signal part and the surround channel signal parts. Particularly, the audio reproducing device is characterized in that the input signal comprises a center channel signal part C, a left and a right channel signal part L and R, and a left and right surround channel signal part $L_s$ and $R_s$, that the speech-music discriminator supplies the control signal in response to the center channel signal part C, and that enhancing means are provided for only the center channel signal part C and the surround channel signal parts $L_s$ and $R_s$, said enhancing means being controlled by said control signal.

In WO 02/50831 A2, an example of a transfer function of the enhancing means for each of the m-channel signal parts is given. However, that transfer function is not appropriate for controlling the enhancement of the relevant sound signals. According to the invention, the transfer function is depending on the probability p. Examples thereof are given in the further description.

The invention not only relates to an audio reproducing device, but also to a method of processing an m-channel part of an n-channel audio signal which is subjected to speech enhancement. This method is characterized by generating, in response to one of the channel signal parts of said m-channel signal part, a control signal indicating the probability that said one of the channel signal parts comprises speech signals, and by controlling the processing of enhancing the m-channel audio signal part with the aid of said control signal.

The invention also relates to a computer program for processing an m-channel part of an n-channel audio signal which is subjected to speech enhancement as described in said method, the computer program being capable of running on signal processing means in an audio reproducing apparatus with the audio reproducing device as described in the specification. In connection therewith, the invention also relates to any information carrier carrying such a computer program.

The invention further relates to an audio reproducing apparatus comprising the audio reproducing device as described above, means for generating or receiving audio signals, said audio signals being supplied to the audio reproducing device, and loudspeakers connected to said audio reproducing device.

BRIEF DESCRIPTION OF THE DRAWING

The invention will be apparent from and elucidated with reference to the examples as described in the following and to the accompanying drawing, in which the sole FIGURE shows, schematically, the audio-reproducing device according to the invention.

DESCRIPTION OF THE PREFERRED EMBODIMENTS

The block diagram in the FIGURE shows an audio reproducing device 1 with five discrete input channels: left (L), right (R), center (C), left surround ($L_s$) and right surround ($R_s$). The output signals are given by the corresponding primed symbols. It may be noted that the five input channels may be derived from less than five channels, e.g., using a 2-to-5 decoder. Also, the five output signals can be reduced, e.g., using 5-to-2 conversion means. The audio reproducing device 1 comprises a speech-music discriminator 2 and enhancing means 3.

The speech-music discriminator 2 is of the type described in the above-mentioned article of Ronald M. Aarts and Robert Toonen Dekker in the J. Audio Eng. Soc., and supplies, in response to an input signal via the center channel (C), an output signal indicating the probability p that this input signal can be considered as speech. p can have values between 0 and 1, wherein the higher the probability that the input signal is speech, the closer p will be to 1. If this input signal has a small chance of being speech, p is close to zero. The output signal of the speech-music discriminator 2 forms a control signal for the enhancing means.

In the present embodiment, the enhancing means is applied to the center channel and the surround channels. All three channels are processed in the same manner. However, depending on the requirements of the reproduction set, the implementation can be changed so that the enhancement means, controlled by the speech-music discriminator, is only applied to the center channel, or that enhancing means, controlled by the speech-music discriminator, is only applied to the center channel, while a fixed enhancing means is applied to the surround channels.

The enhancing means is of the type described in WO 02/50831 A2. However, in the present embodiment, the transfer function is depending on the probability p. A specific example for the relation between the input x and the output y of the enhancing means in the center and surround channels is:

$$y(x,p)=(1-p)x+pc\tan h(ax/c),$$

where a and c are constants. For p=0, this relation simplifies to y=x; this means that if the input signal for the center channel has a small chance of being speech, the enhancing means has no effect. For p=1, the relation simplifies to y=c tan h(ax/c). If x is relatively small y=ax; in the enhancing means, a gain 'a' is applied to the input signal (typically a=2). If x is relatively large, the output signal y saturates to c. For intermediate values of p, a smooth transition between these two regions is obtained. For all values of p, in the linear region: y=[1−(a−1)p] x. The higher the probability that the input signal is speech, the higher the gain in the transfer function will be. This means that speech in the center channel will be enhanced, but that music and noise in the surround channels is somewhat negatively influenced. In the non-linear region, where y saturates, speech enhancement in the center channel is superfluous, while possible sound deformation in the surround channels is acceptable.

Another example for the relation between the input x and the output y of the enhancing means in the center and surround channels is:

$$y(x,p)=c\tanh[(1+ap)x/c].$$

For small values of x, this relation simplifies to:

$$y=(1+ap)x.$$

With a=1, the gain for small signals is the same as in the first mentioned transfer function with a=2. For relatively large signals, y saturates again to c (c≠0). It will be clear that other transfer functions will be possible.

Due to the nature of the speech-music discriminator, the value of p is time varying. Although it might be expected that this leads to annoying sounds, because the variation in p will be reflected in a varying enhancement of the relevant audio signals, in practice, such annoyance did not occur. The overall effect is that speech is enhanced, giving a higher intelligibility. Non-speech sounds are not processed.

Further, it may be noted that even if the speech-music discriminator makes an incorrect decision about the control signal, i.e., p is close to 0 although an input audio signal should have been considered as speech, or vice versa, this will not lead to annoying artefacts. Merely, a different output amplitude of center and surround channels than would be optimal is obtained.

The embodiments described above may be realized by an algorithm, at least part of which may be in the form of a computer program capable of running on signal processing means in an audio reproducing apparatus. In so far as part of the figure show units to perform certain programmable functions, these units can be considered as subparts of the computer program.

The invention is not restricted to the described embodiment. Modifications are possible. Hence, other speech-music discriminators can be used, for example, a discriminator that gives a 'hard' decision about the input signal: either speech (p=1) or music/non-speech (p=0), with no possibilities in-between. This would result in a hard switch between speech enhancement on/off. An improvement in this case can be obtained by low-pass filtering the output signal of the speech-music discriminator. Also, other transfer functions with a functional behavior as described above will be possible.

What is claimed is:

1. An audio reproducing device comprising an input for receiving an n-channel input signal, an output for supplying an 1-channel output signal to 1 loudspeakers, and an audio processing unit for processing the input signal, said audio processing unit comprising enhancing means for enhancing an m-channel signal part of the n-channel input signal, where m<n, the enhancing means having, for each channel signal part of said m-channel signal part, a non-linear anti-symmetric monotone transfer function, characterized in that the audio reproducing device further comprises a speech-music discriminator for providing, in response to one of the channel signal parts of said m-channel signal part designated for speech, a control signal indicating the probability p that said one of the channel signal part comprises speech signals, said control signal being applied to the enhancing means for controlling the enhancing means wherein the transfer function of the enhancing means for each of the m-channel signal parts is dependent on the value of probability p.

2. An audio reproducing apparatus, comprising the audio reproducing device as claimed in claim 1, means for generating or receiving audio signals, said audio signals being supplied to the audio reproducing device, and loudspeakers connected to said audio reproducing device.

3. An audio reproducing device comprising an input for receiving an n-channel input signal, an output for supplying an 1-channel output signal to 1 loudspeakers, and an audio processing unit for processing the input signal, said audio processing unit comprising enhancing means for enhancing an m-channel signal part of the n-channel input signal, where m<n, the enhancing means having, for each channel signal part of said m-channel signal part, a non-linear anti-symmetric monotone transfer function, characterized in that the audio reproducing device further comprises a speech-music discriminator for providing, in response to one of the channel signal parts of said m-channel signal part designated for speech, a control signal indicating the probability p that said one of the channel signal part comprises speech signals, said control signal being applied to the enhancing means for controlling the enhancing means, characterized in that the transfer function of the enhancing means for each of the m-channel signal parts is dependent on the probability p, and characterized in that the transfer_function of the enhancing means is:

$y(x,p)=(1-p)x+pc \tan h(ax/c)$, wherein y is the output, x is the input, p is the probability, and a and c are adjusted constants.

4. An audio reproducing device comprising an input for receiving an n-channel input signal, an output for supplying an 1-channel output signal to 1 loudspeakers, and an audio processing unit for processing the input signal, said audio processing unit comprising enhancing means for enhancing an m-channel signal part of the n-channel input signal, where $m<n$, the enhancing means having, for each channel signal part of said m-channel signal part, a non-linear anti-symmetric monotone transfer function, characterized in that the audio reproducing device further comprises a speech-music discriminator for providing, in response to one of the channel signal parts of said m-channel signal part designated for speech, a control signal indicating the probability p that said one of the channel signal part comprises speech signals, said control signal being applied to the enhancing means for controlling the enhancing means, characterized in that the transfer function of the enhancing means for each of the m-channel signal parts is dependent on the probability p, and characterized in that the transfer_function of the enhancing means is:

$y(x,p)=c \tan h[(1+ap)x/c]$, wherein y is the output, x is the input, p is the probability, and a and c are adjusted constants.

5. A method of processing an m-channel part of an n-channel audio signal, characterized in that said method comprises the steps:

generating, in response to one of the channel signal parts of said m-channel signal part, a control signal, indicating a probability that said one of the channel signal parts contains speech signals; and enhancing the m-channel audio signal part under control of said control signal, said enhancing step utilizing a transfer function in accordance with $y(x,p)=(1-p)x+pc \tan h(ax/c)$, where y is the output, x is the input, p is the probability, and a and c are adjusted constants.

6. A computer program for processing an m-channel part of an n-channel audio signal as described in the method as claimed in claim 5, the computer program being capable of running on signal processing means in an audio reproducing apparatus.

7. An information carrier containing the computer program claimed in claim 6.

* * * * *